United States Patent [19]

Keller

[11] 3,951,282

[45] Apr. 20, 1976

[54] METHOD FOR FEEDING FIBERS

[76] Inventor: Alex Jacques Keller, 2222 Scottwood Drive, Gastonia, N.C. 28052

[22] Filed: Sept. 20, 1974

[21] Appl. No.: 507,792

Related U.S. Application Data

[62] Division of Ser. No. 409,297, Oct. 24, 1973, abandoned.

[52] U.S. Cl. ..... 214/152; 19/80 R; 19/145.5; 214/16 R; 214/44 A; 214/87; 214/309

[51] Int. Cl.[2] ..... D01G 13/00

[58] Field of Search ..... 214/16 R, 16 B, 38 CA, 214/152, 87, 44 R, 44 A, 309; 212/125–127, 131, 132; 19/80 R, 81, 145.5

[56] References Cited

UNITED STATES PATENTS

| | | | |
|---|---|---|---|
| 2,412,844 | 12/1946 | Stevens | 214/16 R |
| 2,980,264 | 4/1961 | Burt et al. | 212/132 |
| 3,577,599 | 5/1971 | Goldammer | 19/145.5 |
| 3,806,990 | 4/1974 | Goldammer | 19/145.5 |

*Primary Examiner*—Robert G. Sheridan
*Attorney, Agent, or Firm*—Richards, Shefte & Pinckney

[57] ABSTRACT

A system is provided for accurately positioning bales of fibrous material in relation to a mechanical means for transporting fibers from said bales to the hoppers of fiber feeders.

6 Claims, 2 Drawing Figures

METHOD FOR FEEDING FIBERS

CROSS-REFERENCE TO RELATED APPLICATIONS

This application is a divisional application of United States patent application Ser. No. 409,297, filed Oct. 24, 1973, and now abandoned.

BACKGROUND OF THE INVENTION

In the processing of naturally occurring fibers, such as cotton, it is the usual practice to mix fibers from a plurality of bales to improve uniformity. Commonly, this is done by removing segments from a plurality of bales and dumping these segments into the hopper of a fiber feeder.

If this operation is performed by hand, it is extremely laborious, hot and dirty work. Thus, several attempts have been made in the prior art to mechanize this operation. Exemplary of such attempts are U.S. Pat. No. 3,577,599 to Golddammer, entitled "Apparatus for Mixing Fibrous Components."The Goldammer patent discloses a wheeled fiber plucking mechanism movable between a row of bales arranged behind bale openers. The fiber plucking mechanism in the Goldammer patent is selectively engageable with successive bales for the purpose of plucking quantity of fibers therefrom. Movement of the Goldammer fiber plucker is limited to travel in the space between rows of bales and behind the group of openers.

An improved apparatus permitting removal of fibers from a greater number of bales, and thus permitting greater uniformity of mixing, is disclosed in application Ser. No. 275,942, filed July 28, 1972, by Alex J. Keller, now U.S. Pat. No. 3,777,908.

Basically, the mechanical hopper feeder apparatus disclosed in the Keller application comprises a fiber plucker having a vertically extendable pickup head. The fiber plucker is supported by and movable along a first pair of horizontal overhead tracks which are, in turn, supported at their ends upon a second pair of horizontal overhead tracks positioned transversely with respect to the first pair of tracks. Thus, by movement of the fiber plucker along the first pair of tracks and movement of the first pair of tracks along the second pair of tracks, the fiber plucker is positionable at any point within a rectangular area defined by the spacing of overhead tracks. In operation, the fiber plucker can be moved over any one of a large number, e.g. 40 or so, bales within the processing area to remove a mass of fibers therefrom and then transport the fibers to the hopper of one of several fiber feeding machines positioned alongside the bale area.

In employing a mechanical means such as described, for example, in the aforesaid Keller application, it is of critical importance that the fiber bales be precisely located within plus or minus 3 inches in either direction at predetermined locations in order that the pickup head will descend into the central portion of the bale during fiber plucking. Such positioning is of particular importance when the fiber plucker has been electrically programmed to move from one location to another in accordance with a predetermined program, or limit switches or cams associated with the apparatus. To date, this placement has required careful location of the bales by hand within the processing area of careful spacing and positioning of the bales upon a conveyor which then transports the bales into the processing area.

SUMMARY OF THE INVENTION

The present invention relates to a bale handling system for use in conjunction with mechanical fiber plucking apparatus, and in particular relates to a system for readily and accurately positioning fiber bales at predetermined locations within a bale assembly area. While the preferred embodiment of the invention will be described in relation to an apparatus of the type disclosed in the aforesaid Keller application, it will be understood that the particular embodiment may be readily adapted to be used in conjunction with similar or other types of apparatus.

In accordance with the present invention, bales of fibers to be processed are placed upon bale supporting means which are then moved along guide means or guide ways into the bale assembly area.

It is an object of the present invention to provide a system for uniformly positioning fiber bales within the bale assembly area of a mechanical fiber plucker.

It is another object to provide a fiber bale handling and positioning apparatus comprised of a plurality of parallel tracks and a plurality of bale supporting means movable upon and guided by said tracks.

It is yet another object of the invention to provide a fiber plucking apparatus comprised of a mechanical fiber plucker movable to predetermined positions over a bale assembly area and means for moving bales to predetermined locations within said area.

Other objects of the present invention, if not specifically set forth herein, will be obvious to the skilled artisan upon a reading of the detailed description of the invention which follows, particularly when taken in conjunction with the drawings.

DESCRIPTION OF THE PREFERRED EMBODIMENT

Figure 1:
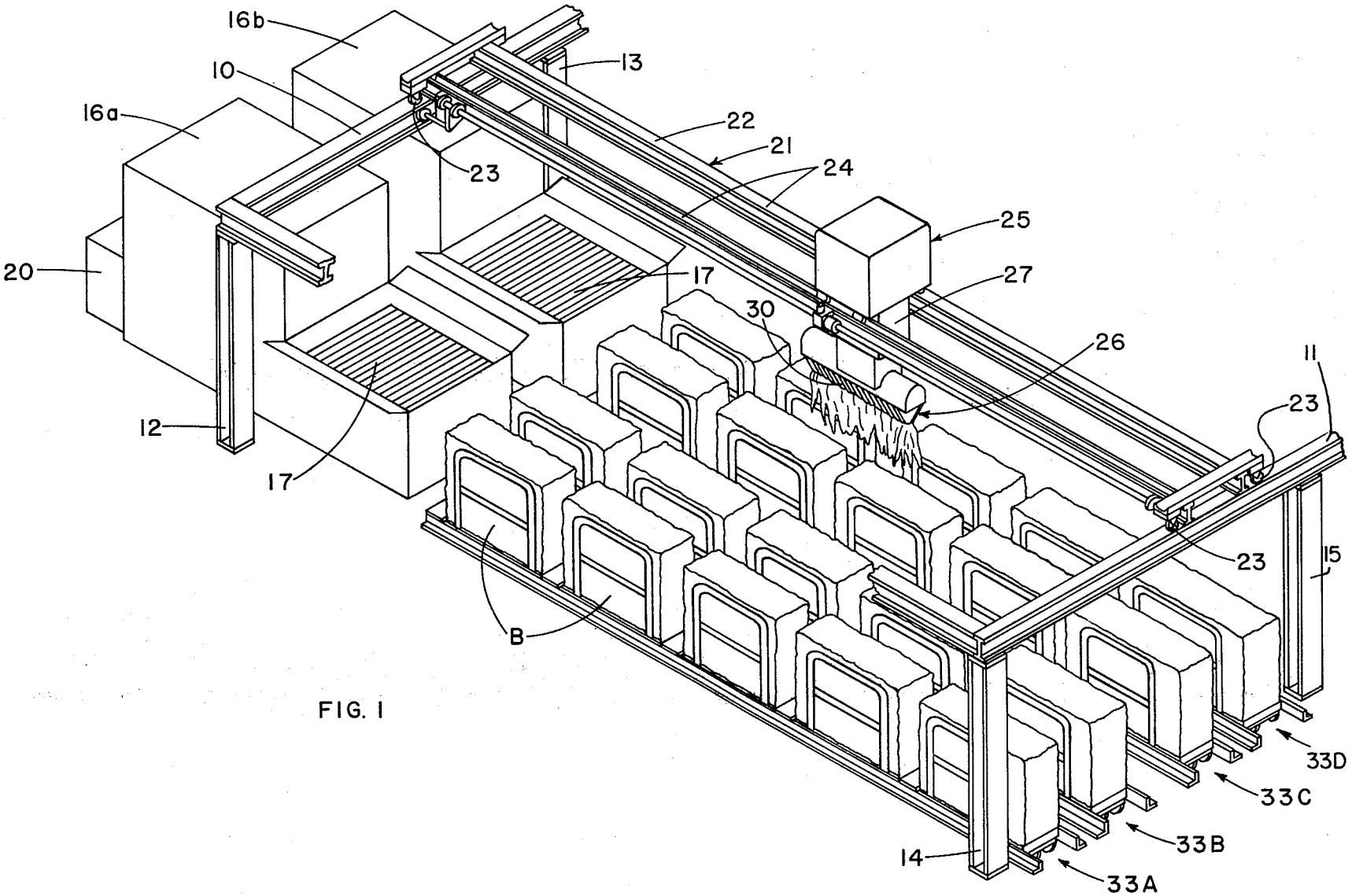
FIG. 1 is a perspective view of a bale assembly area and its associated apparatus, with parts broken away.

In general, the present apparatus comprises a plurality of parallel guide ways, or guide means, extending across the bale area of a mechanical fiber plucking apparatus and plurality of bale supporting means adapted to move along, and be guided by, said track ways. In the following description, the apparatus is described in conjunction with the fiber plucker apparatus claimed in the aforementioned Keller application. It is to be understood however that the present apparatus may also be suitably employed as part of the other systems.

Referring now to the illustrated embodiment, a first set of trackways comprising a track 10 and a track 11 are suitably supported or suspended about 8 or 12 feet above the floor F of a fiber processing plant. In the illustrated embodiment, the tracks 10 and 11 are supported by posts 12 and 13 at the ends of track 10 and by posts 14 and 15 at the ends of track 11. Track 10 is supported above and extends across a group of fiber feeding machines sometimes called bale breakers, two of which are shown and identified by the reference numerals 16*a* and 16*b*. There may be any number of bale breakers served by the fiber plucker apparatus, six breakers being an average number. Only two are shown here for purposes of illustration. Each of the openers may be like that shown and described in the Lytton U.S. Pat. No. 3,132,709 or of any other suitable construction. Each opener includes a hopper 17 into which fibers are deposited for processing within the opener and thereafter delivered to a conveyor 20 extending transversely along the row of openers. The conveyor 20 comprises an endless belt which transports fibers from the openers to a pneumatic conveyor not shown, which transports the fibers to a carding machine or the like.

The track 10 is supported above the group of breakers and extends transversely of the path of the fibers through the breakers. Track 11 is supported in the same horizontal plane as track 10 but spaced rearwardly therefrom a sufficient distance to define an assembly area wherein fiber bales B are located. A distance of about 25 feet has been found sufficient for this purpose. Each of the breakers is about 3 feet in width and if the track 10 overlies six breakers, the tracks 10 and 11 may, therefore, be conveniently about 40 feet long.

A plurality of bales B of fibers, such as cotton, are arranged in the assembly area behind the breakers and between the tracks 10 and 11, by means to be hereinafter described in detail. The bales are of rectangular configuration and may be arranged on the floor in any desired predetermined pattern, but as illustrated are arranged with two longitudinal rows behind each breaker with the longest dimension of the bales extending longitudinally of its row. This arrangement has been found advantageous in conserving floor space and thereby permitting a larger number of bales to be assembled within the assembly area between and beneath the tracks 10 and 11.

If desired, all of the bales in a row behind a given breaker, such as the breaker 16*a*, may contain a fiber of a given kind which is different from the fibers in the remaining bales in the assembly area. Similarly, the bales behind another breaker, such as 16*b*, may contain fibers different from the fibers in the rest of the bales in the processing area. Alternatively, any bale or bales behind the hoppers and within the assembly area may contain fiber which is different from the fiber in other bales within the assembly area. Still another alternative would be for all of the bales in the processing area to contain the same kind of fiber. The point is that the bales within the assembly area may or may not contain different fibers and bales with fibers different from the fibers in other bales may be arranged in any desired pattern. The invention is equally applicable to all arrangements of bales containing the same or different kinds of fibers. Any desired mixing of fibers is accomplished after the fibers are deposited in the hoppers, the only function of the hopper feeder being to deliver fibers to the hoppers—not to mix them.

Extending between the tracks 10 and 11 is a wheeled frame broadly indicated at 21 and including a rectangularly shaped longitudinally extending carriage 22 having wheels 23 journalled at the ends thereof and rotatably mounted for reciprocal movement along the tracks 10 and 11. The frame 21 supports a pair of transversely spaced longitudinally extending tracks 24, upon which is mounted for reciprocal movement therealong a wheeled carriage broadly indicated at 25.

The carriage 25 supports a fiber plucker or tongs broadly indicated at 26 and comprising a vertically reciprocable support shaft 27 and a pair of cooperating tongs or prongs 30 operatively connected to the lower end of the support shaft 27. The prongs 30 are selectively movable toward and away from each other to close upon a quantity of fibers in a bale within the assembly area and to release the fibers plucked from the bale into one of hoppers 17.

The sequence of operations may be controlled through a control circuit including a manually operated or computer operated console operatively connected to the electric, hydraulic, or air motors energizing the movement of the carriage 22 along tracks 10 and 11, carriage 25 along tracks 24, and the raising and lowering the support shaft 27 and the opening and closing of the tongs 30. The console may also include appropriate programming for sensing the volume of fibers within each of the hoppers 17, and be responsive to a volume less than a predetermined minimum to cause the fiber plucker to move an appropriate kind of fiber from one of the bales in the assembly area to the hopper requiring replenishment.

Figure 2:
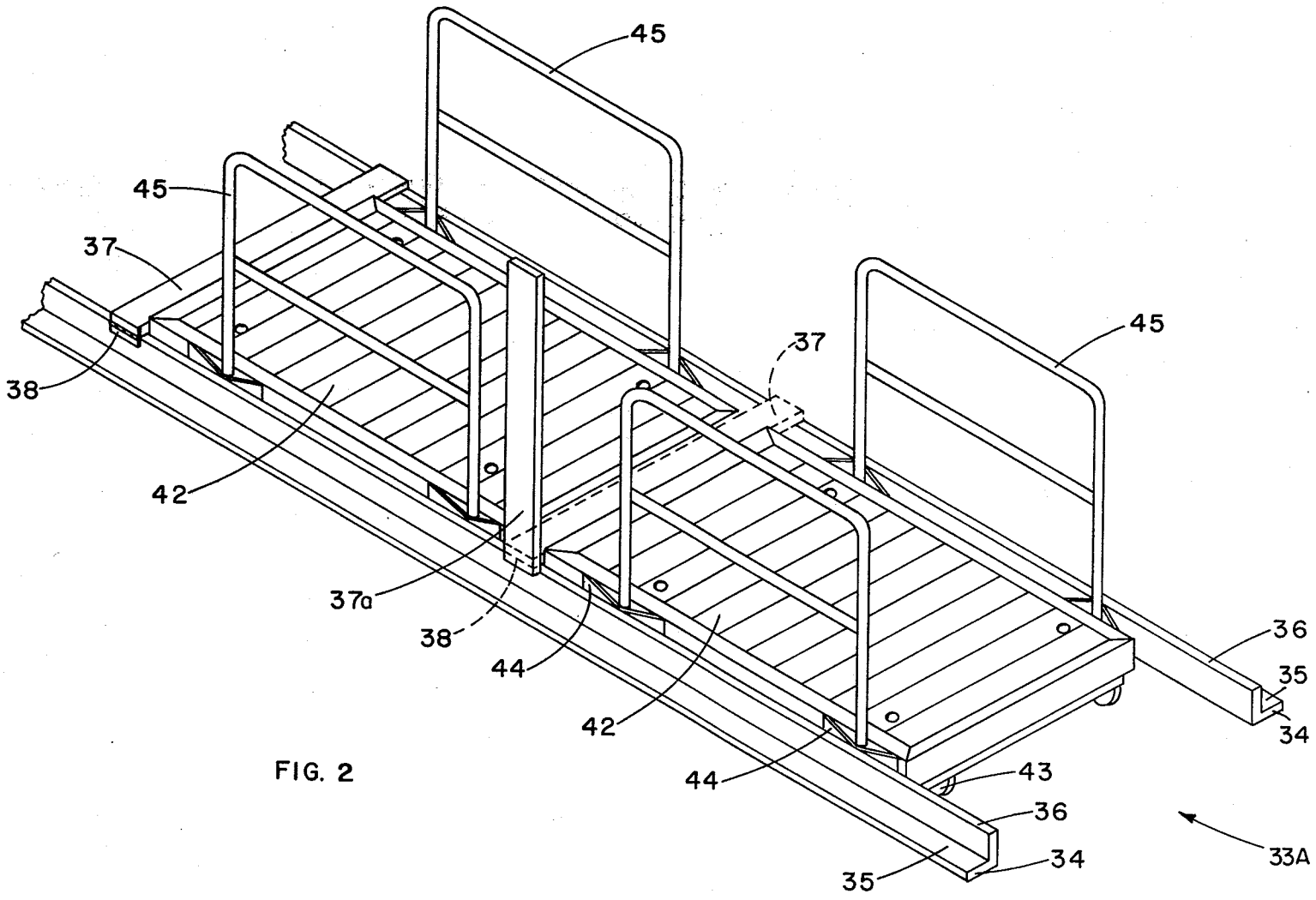
FIG. 2 is a perspective view with parts broken away, of one embodiment for moving bales within the bale assembly area.

The apparatus for positioning bales with the assembly area at predetermined locations is comprised of a plurality of guide means, shown generally at 33A, 33B, 33C, 33D . . . . Each guide means is comprised of a pair of spaced parallel angle irons 34, each angle iron 34 having a horizontal outwardly extending foot 35 and an upright portion 36; the angle irons or rails forming each guide means being spaced a first given dimension transversely of the path of movement of bales along the guide means. At spaced positions along alternate angle irons 34 are hinged arms 37 secured to each alternate as by hinge 38 and adapted to be moved from an inoperative vertical position as shown at 37A in FIG. 2 to a horizontal operative position extending between proximate rails 34. Arms 37 are spaced longitudinally of the path of movement of bales along the guide means a second given dimension. The angle irons and hinged arms are positioned such that the first and second dimensions define the limits of a predetermined zone within the assembly area for the positioning of successive bales B.

Bales B are supported upon movable support means, which comprises a pallet 42 having an upper surface with dimensions approximating those of bale B. Pallet 42 is supported upon a plurality of wheels 43 or casters. Spacers 44 are secured on each side of pallet 42. In the preferred embodiment, spacers 44 comprise laterally projecting tubular members which are welded to the sides of pallet 42. Removable side walls 45 are insertable between spacers 44 and the sides of the pallet members to hold bale B on pallet 42. The dimensions of the pallets 42 is such that the dimension across the pallet from the outer edge of opposed spacers 44 is slightly less than the space between the angle irons 34 forming the guide means, so that the pallets may be rolled between proximal angle irons 34. The longitudinal dimension of pallet 42 is slightly less than the distance between adjacent hinged arms or spacer bars 37, so that when two bars are positioned across proximal angle irons 34 such as guide means 33A, pallet 42 therebetween will be precisely located in a predetermined position within the assembly area for access by the fiber plucker 30, which may be programmed to stop only at designated points within the assembly area. Once properly positioned the pallet 42 will be prevented from longitudinal or transverse movement.

In operation, a bale B is positioned onto a first pallet 42 and wheeled between proximal angle irons 34, such as guide means 33A until it rest against a first arm 37 adjacent the hopper 17. The next successive or second arm 37 is then moved from its vertical inoperative position across the angle irons and behind pallet 42 to precisely position the first pallet and form a forward stop for the next succeeding pallet. The next pallet 42 and its bale between the angle irons 36 defining guide means 33A and brought into contact with the second arm. A third arm is then brought in position behind the bale support means and the sequence of steps is continued until the desired number of bales is positioned along the guideway. A similar sequence of events is carried out along each guide means until the desired number of bales have been positioned within the processing area.

It is to be understood that the essence of the present invention is an apparatus for positioning bales of fibrous material within an assembly area at predetermined locations which comprises a plurality of bale support means which are adapted to travel along a plurality of parallel guideways to predetermined positions within the assembly area. For example, the objects of the present invention may be accomplished by a plurality of parallel grooves within the floor of the processing area, and bale support means having pins projecting downwardly therefrom for engagement with the groove. It is also within the spirit of the invention to eliminate the hinged arms 37 and use a fixed stop adjacent the hoppers to locate the first pallets in each guide means. The rest of the pallets will be positioned against the first pallets in each row and against each other and properly dimensioned to precisely position their respective bales at predetermined points in the assembly area.

I claim:

1. An improved method for feeding fibers from bales of fibers to the hopper of a fiber feeding machine, said method comprising:

a. Defining a bale assembly area adjacent the hopper and extending longitudinally therefrom, b. Determining a precise location within the assembly area for each of a plurality of bales, c. Supporting each of said bales and mechanically confining each said supported bale within a space corresponding substantially to one of said precise locations within said bale assembly area, d. Coordinating the location of said confined bales within the assembly area with the movement of an automatically operated machine for plucking fibers from said bales, e. Automatically and selectively moving said machine for plucking fibers to a position above any said precise bale location within the assembly area, and plucking a given amount of fibers from said bale confined thereat, f. Automatically moving said machine for plucking fibers from said bale with the fiber plucked therefrom to said hopper and depositing said given amount of fibers in the hopper, and g. Repeating steps e and f.

2. A method according to claim 1 wherein said precise location within the assembly area for each of a plurality of bales is confined to longitudinally successive uniformly dimensioned spaces in each of two parallel rows extending longitudinally through the assembly area from said hopper, each of said spaces being dimensioned to accommodate a bale.

3. A method according to claim 2 wherein the spaces in each of said rows are arranged in end to end relationship with respect to each other.

4. A method according to claim 1 wherein fibers are fed from bales of fibers to the hoppers of a plurality of fiber feeding machines and wherein the bale assembly area is adjacent the hoppers of the fiber feeding machines and extends longitudinally therefrom.

5. A method according to claim 4 wherein said precise location within the assembly area for each of a plurality of bales is confined to longitudinally successive uniformly dimensioned spaces in each of two parallel rows extending longitudinally through the assembly area from each of said hoppers, each of said spaces being dimensioned to accommodate a bale.

6. A method according to claim 5 wherein the spaces in each of said rows are arranged in end to end relationship with respect to each other.

* * * * *